United States Patent [19]

Frese, Jr. et al.

[11] Patent Number: 4,609,441

[45] Date of Patent: Sep. 2, 1986

[54] ELECTROCHEMICAL REDUCTION OF AQUEOUS CARBON DIOXIDE TO METHANOL

[75] Inventors: Karl W. Frese, Jr., Cupertino; Steven C. Leach, Menlo Park; David P. Summers, San Francisco, all of Calif.

[73] Assignee: Gas Research Institute, Chicago, Ill.

[21] Appl. No.: 810,912

[22] Filed: Dec. 18, 1985

[51] Int. Cl.[4] ..... C25B 3/00

[52] U.S. Cl. ..... 204/77

[58] Field of Search ..... 204/72, 77, 292

[56] References Cited

U.S. PATENT DOCUMENTS 3,959,094 5/1976 Steinberg ..... 204/72

*Primary Examiner*—R. L. Andrews

*Attorney, Agent, or Firm*—Fliesler, Dubb, Meyer & Lovejoy

[57] ABSTRACT

A method of producing methanol from carbon dioxide is set forth. A solution of carbon dioxide in an aqueous solvent having electrolyte dissolved therein is electrolyzed utilizing a molybdenum cathode. Faradaic efficiency is generally quite high and without detectable corrosion.

3 Claims, 7 Drawing Figures

ELECTROCHEMICAL REDUCTION OF AQUEOUS CARBON DIOXIDE TO METHANOL

TECHNICAL FIELD

The invention relates to the electrochemical reduction of aqueous carbon dioxide to form methanol.

BACKGROUND

The reduction of carbon dioxide at semiconductor electrodes has been the focus of study in recent years with the goal of developing a system for the storage of solar energy as carbon based fuel. One such fuel is methanol which can be used to replace hydrocarbon fuels without major adjustments. Metal electrodes have also been studied since they offer the possibility of superior catalytic properties and can be coupled to solid state photoelectrical cells for solar energy storage. The reduction of carbon dioxide to methanol has been demonstrated on p-GaP, n- and p-GaAs, n-Si and P-InP (M. Halmann, Nature 275 (1978) 115, T. Inoue, et al, Nature 277 (1979) 637, D. Canfield, et al, J. Electrochem. Soc. 130 (1983) 1772 and D. Canfield, et al, J. Electrochem. Soc. 131 (1984) 2518. Reduction at n-GaAs is selective with nearly 100% faradaic efficiencies. Unfortunately, at pH 4.2 a potential of −1.2 V to −1.4 V vs SCE is necessary to drive the reduction with high faradaic efficiencies although the standard potential for the reduction of carbon dioxide to methanol, derived from the value for heat of formation found in Selective Values of Chemical Thermodynamic Properties, United States National Bureau of Standards, Technical Note No. 290 -2, at pH 4.2 is only −0.563 V vs. SCE. Semiconductor electrodes are also inherently susceptible to corrosion (A. J. Bard, et al, J. Electrochem. Soc. 124 (1979) 1706 and H. Gerischer, J. Electroanal. Chem. 82 (1977) 133). Indeed, some of the materials that have been shown to make methanol suffer from corrosion in parallel with the electrocatalytic reduction of carbon dioxide.

Previous electrolytic reduction of carbon dioxide at metal electrodes has led to reduction of the carbon dioxide to formic acid or carbon monoxide when the electrodes were Pd, Pt and Hg. (W. Paik, et al, Electrochimica Acta 19 (1969) 1217, V. Kaiser, et al, Br. dB. Gesellschaft 77 (1973) 818, T. N. Andersen, et al, Stud. Trop. Oceanogr. 5 (1965) 229, P. G. Russel, et al, J. Electrochem. Soc. 124 (1977) 1329 and S. Kapusta, et al, J. Electrochem. Soc. 130 (1983) 607).

The present invention is directed to overcoming one or more of the problems as set forth above.

DISCLOSURE OF INVENTION

In accordance with the present invention a method is set forth of producing methanol from carbon dioxide comprising electrolyzing a solution of carbon dioxide in an aqueous solvent having an electrolyte dissolved therein and utilizing a cathode which comprises molybdenum.

The method as set forth above has faradaic efficiencies of over about 50% and at times nearly 100%. The potentials for the electrolysis are generally less than 200 mV negative of the standard potential corrected for pH.

DESCRIPTION OF DRAWINGS

The invention will be better understood by reference to the figures of the drawings wherein.

BEST FOR CARRYING OUT INVENTION

Figure 1:
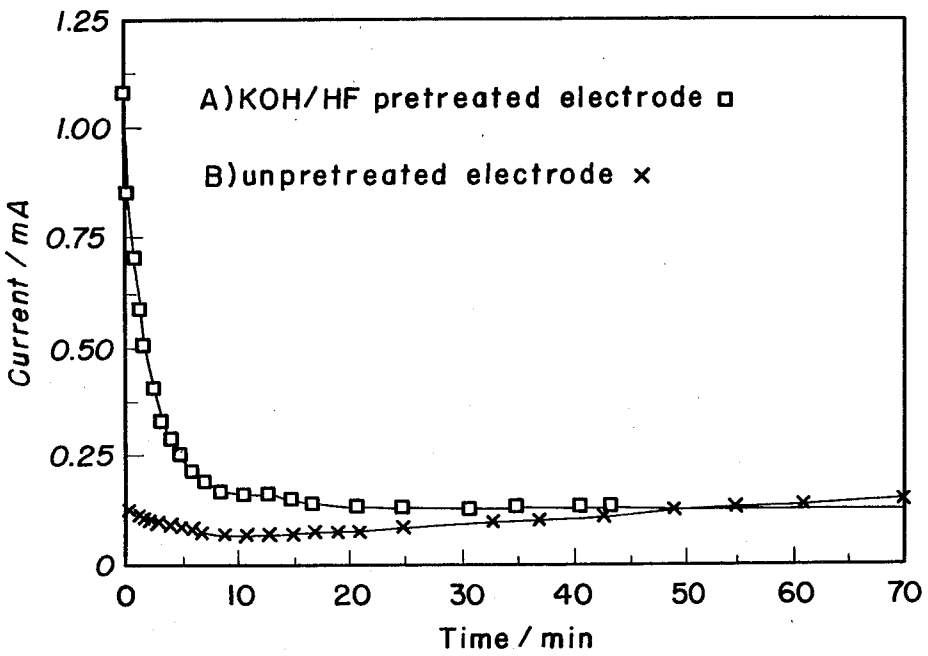
FIG. 1 illustrates current/time plots for controlled potential electrolysis of carbon dioxide in 0.2 $Na_2SO_4$, pH 4.2 at −0.8 V vs. SCE at (a) a KOH/HF pretreated molybdenum electrode and (b) unpretreated molybdenum electrode previously used for electrolysis with the electrode area being 2.9 $cm^2$.

The reduction of carbon dioxide to methanol is represented by the equation:

$$CO_2+6H^++6e^- \rightleftharpoons CH_3OH+H_2O \quad (1)$$

In accordance with the present invention the above reaction is carried out utilizing a molybdenum cathode. A molybdenum cathode can reduce carbon dioxide to methanol selectively and with up to 80 to 100% faradaic efficiency. Such reductions can occur, for example, at −0.7 V vs. SCE at pH 4.2, only 160 mV negative of the standard potential corrected for pH.

The following experimental data all represent actual experiments will serve to give a better understanding of the invention.

EXPERIMENTAL

Materials

All solutions were either 0.2 M reagent grade sodium sulfate or 0.05 M reagent grade sulfuric acid in distilled deionized. Electrodes were prepared by mounting either molybdenum foil or wire at the end of a Cu wire in a glass tube and sealing with epoxy. The electrodes were cleaned either by dipping in concentrated hydrochloric acid or by rubbing the electrode with a cotton tip applicator saturated with concentrated sodium hydroxide several times, followed by sonicating the electrode in the sodium hydroxide solution for ten minutes and finally soaking in 30% hydrofluoric acid for five minutes. The KOH/HF treatment gave more reproducible yields. Molybdenum bronzes were prepared according to the method of R. Schollorn, et al, Mat. Res. Bull. 11 (1976) 83. A molybdenum trioxide powder was stirred in a 1 M solution of sodium dithionite under nitrogen for a 2 hour time period during which the characteristic blue color formed. The dithionite solution was decanted and the powder was then washed several times with water.

Equipment

Unless otherwise noted all experiments were done at room temperature. Cyclic voltammetry experiments were performed with a Pine Instrument Corporation model RDE3 potentiostat. A P.A.R. model 172 potentiostat was used with a model 179 coulometer plugin to measure charge passed during cycling. Electrolyses were performed using an Aardvark model PEC-1 potentiostat and Keithly model 616 digital electrometer with a strip chart recorder for measuring current as a function of time. All electrolyses were carried out using a carbon dioxide gas circulating closed system as previously described by D. Canfield and K. W. Frese, Jr., J. Electrochem. Soc. 130 (1983) 1772. In all cases electrolyte volumes were either 25 or 50 ml. Samples were analyzed on a Gowmac model 750 gas chromatograph with a FID detector. The samples for methanol were collected from the vapor in a 1 ml headspace over a 2 ml aliquot. A 6 foot Porpak N column at 130 ° C. was used for methanol analysis while a column of Porpak Q (6 ft) followed by Porpak R (3 ft) at 50 ° C. was used for methane/carbon monoxide analysis. Atomic absorption analysis for molybdenum was performed by Data Lab Inc., San Jose, Calif.

Results and Discussion Electrolysis Experiments

In Tables 1 and 2 the faradaic efficiencies for the electrolysis of carbon dioxide saturated aqueous solution of 0.2 M $Na_2SO_4$ (pH 4.2) or 0.05 M $H_2SO_4$ (pH 1.5) with an HCl pretreated and KOH/HF pretreated (see experimental) molybdenum electrode are listed. As can be seen methanol is made in significant amounts at both pH's.

TABLE 1

Faradaic Efficiencies for $CH_4$, CO, and $CH_3OH$ on HCl pretreated molybdenum electrodes.[a]

| Electrolyte | T/°C. | E/V vs SCE | $j^b$/μA $cm^{-2}$ | Q/coul | Efficiency[c] $CH_4$ | CO | $CH_3OH$ |
|---|---|---|---|---|---|---|---|
| 0.2 M $Na_2SO_4$ | 22 | −0.70 | 26 | 11.8 | 2 | 21 | 42 |
| 0.2 M $Na_2SO_4$ | 22 | −0.80 | 50 | 8.5 | ND | 3 | 55 |
| 0.05 M $H_2SO_4$ | 22 | −0.57 | 100 | 50 | 3 | 1.5 | 23 |
| 0.05 M $H_2SO_4$ | 22 | −0.68 | 550 | 86 | 0.15 | 0.11 | 3.7 |
| 0.05 M $H_2SO_4$ | 22 | −0.68 | 310 | 18.7 | ND | 0.2 | 46 |
| 0.05 M $H_2SO_4$ | 52 | −0.60 | 590 | 87.6 | ND | 0.5 | 21 |

[a]All controlled potential electrolysis in $CO_2$ saturated solutions.
[b]Average current density.
[c]% faradaic efficiency.

TABLE 2

Faradaic Efficiencies for CO and $CH_3OH$ on KOH/HF pretreated molybdenum electrodes.[a]

| Trial | Time/ hr | E/ V vs SCE | $j^b$/ μA $cm^{-2}$ | Q/ coul | Efficiency[c] CO | $CH_3OH$ |
|---|---|---|---|---|---|---|
| 1[d] | 46.9 | −0.52 to −1.1 | 100 | 16.9 | 0.3 | 77 |
| 2A | 23.3 | −0.8 | 120 | 13.9 | N.D.[g] | 84 |
| 2B[e] | 72.5 | −0.8 | 57 | 21.5 | 0.4 | 36 |
| 3A | 43.4 | −0.8 | 61 | 27.5 | N.D.[g] | 45 |

TABLE 2-continued

Faradaic Efficiencies for CO and $CH_3OH$ on KOH/HF pretreated molybdenum electrodes.[a]

| Trial | Time/ hr | E/ V vs SCE | $j^b$/ μA $cm^{-2}$ | Q/ coul | Efficiency[c] CO | $CH_3OH$ |
|---|---|---|---|---|---|---|
| 3B[f] | 69.8 | −0.8 | 33 | 24.4 | N.D.[g] | 15 |

[a]All in $CO_2$ saturated 0.2 M $Na_2SO_4$ solution at 22° C.
[b]Average current density.
[c]% faradaic efficiency.
[d]Controlled current electrolysis.
[e]2B is a continuation of 2A after sampling. Numbers for 2B do not include electrolysis before sampling.
[f]3B represents the electrolysis of a fresh solution with the electrode used in 3A without pretreatment. Numbers for 3B do not include electrolysis before sampling.
[g]N.D. = not detected The faradaic efficiency for methanol formation is good with values ranging as high as 85%. The reaction is fairly selective with the faradaic efficiency for carbon monoxide formation being, except for an occasional result, generally less than 5%. At KOH/HF pretreated electrodes carbon monoxide is consistently formed in less than 3% faradaic efficiency. From the last entry in Table 1 it can be seen that, in contrast to ruthenium electrodes, K.W. Frese, Jr. and S. Leach, J. Electrochem. Soc. 132 (1985) 259, raising the temperature to 52 ° C. does not change the product distribution significantly and at all temperatures methane is only formed in trace amounts. The lack of a faradiac balance is probably caused by hydrogen that is produced during electrolysis but not measured by the flame ionization detector on the gas chromatograph. Indeed, bubbles of gas, presumably hydrogen, can be seen forming on the electrode surfaces. The standard potential for reduction of carbon dioxide to methanol is −0.536 V vs SCE at pH 1. Thus the results in Table 1 represent the reduction of carbon dioxide to methanol only 160 and 190 mV negative of the standard potential for pH's 4.2 and 1.5 respectively.

Table 2 contains the results for two extended electrolysis experiments in 0.2 M $Na_2SO_4$ at pH 4.2 that were conducted to determine if molybdenum electrodes continued to make methanol over an extended period of time. Entry 2 A shows that an electrode that had passed 14 coulombs over the period of one day had made methanol with a faradaic efficiency of 84%. Continuation of the electrolysis for another 2 days allowed another 22 coulombs to be passed. While the methanol efficiency dropped to 36% during this second period of time, methanol production did not come to a halt with an additional 14 μmol of methanol being produced. To see if the drop in efficiency was due to a change in the electrode surface characteristics or due to a change in the solution composition, another electrode was used to pass 28 coulombs over a two day period, and then used to electrolyze a fresh solution without surface pretreatment. During the first period (entry 3 A) methanol was produced with an efficiency of 45%. During the second period (entry 3 B) the faradaic efficiency declined to 15% indicating that the drop in electrode efficiency is due to a change in the electrode surface characteristics. A possible explanation for the drop in efficiencies is the deposition of impurities, such as Hg or As, from the electrolyte during electrolysis.

FIG. 1*a* shows the current-time characteristics of electrolysis 3 A above. The large initial current drop is characteristic of all electrolyses at pH 4.2. It is possible that the drop in current primarily results from the same effect that causes a decrease in the efficiency during extended electrolysis. In FIG. 1*b* we see the current-time characteristics of electrolysis 3 B with the electrode which had previously been used for electrolysis 3 A (represented in FIG. 1*a*) and was used again in a fresh electrolyte without pretreatment. The initial drop in current is an order of magnitude less than for a "fresh" electrode indicating that the drop is indeed due to a change in the surface characteristics of the electrode. It is also possible that a decline in the rate of hydrogen evolution, caused by the buildup of a significant hydrogen pressure, contributes to the current drop.

Corrosion Experiments

If a molybdenum wire is placed at open circuit in a carbon dioxide saturated 0.2 M $Na_2SO_4$, pH 4.2 solution carbon monoxide is formed. However no methanol is detected (Table 3 ) at uncycled electrodes vide infra. The KOH/HF pretreatment leads to faster carbon monoxide formation than the HCl treatment, but in both cases the rate of carbon monoxide formation (expressed in terms of the current necessary to drive the reduction at that rate) is less than 1 μA. The carbon monoxide formation is probably caused by oxidation of the metal to molybdenum dioxide (eq. 2 ). The reduction of carbon dioxide to carbon monoxide by molybdenum metal to $$Mo+2CO_2 \rightleftharpoons MoO_2+2CO \quad (2)$$

form molybdenum dioxide is downhill (Atlas of Electrochemical Equilibria in Aqueous Solutions, M. Pourbaix, National Association of Corrosion Engineers, Houston, Texas) by $-18$ kJ $mol^{-1}$.

Figure 2:
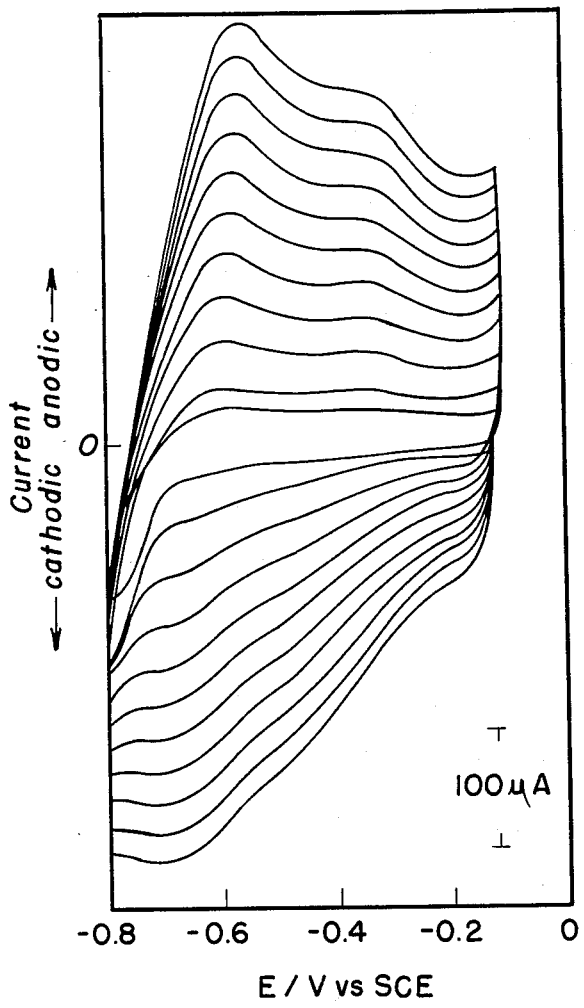
FIG. 2 illustrates cyclic voltammetry for molybdenum electrode in nitrogen saturated 0.2 M $Na_2SO_4$, pH 4.2 aqueous solution, electrode being HCl pretreated and allowed to sit at open circuit for one hour before scanning, sweep rate being 0.5 to 10 V per minute and the electrode area being 3.4 $cm^2$.

The potentiodynamic characteristics of molybdenum foil electrodes were also used to characterize the open circuit reaction with carbon dioxide. A molybdenum electrode was pretreated by dipping in concentrated HCl for 10 minutes. The electrode was placed in a nitrogen saturated 0.2 M $Na_2SO_4$, pH=4.2 aqueous solution at open circuit for one hour. Then the cyclicvoltammetry was measured, the results of which are shown in FIG. 2.

TABLE 3

Open Circuit Corrosion of Molybdenum Wire by Aqueous Carbon Dioxide at Room Temperature[a]

| Pretreatment | Time/ hr | CO/ μmoles | $CH_3OH$/ μmoles | $j_c$[b]/ μA $cm^{-2}$ |
|---|---|---|---|---|
| HCl | 66.2 | 0.31 | N.D.[c] | 0.04 |
| KOH/HF | 46.4 | 3.1 | N.D.[c] | 0.8 |
| | 118 | 3.1 | N.D.[c] | 0.31 |
| HCl[d] | 117 | N.M.[e] | <1 | — |
| | 141 | 2.1 | 6.5 | 1.5 |

[a]All 5 $cm^2$ molybdenum wire in a 0.2 M $Na_2SO_4$ carbon dioxide saturated aqueous solution.
[b]Average free corrosion current for time period indicated.
[c]N.D. = none detected.
[d]Cycled between −1.2 and +0.2 V vs SCE before experiment.
[e]N.M. = not measured.

The potential was scanned from −0.1 to −0.8 V vs SCE and 1.0 to 10.0 V $min^{-1}$ at equal increments of sweep rate. A sweep rate of 0.5 V $min^{-1}$ is also shown. The most distinctive feature is the large anodic peak around −0.6 V; a second smaller peak was observed near −0.3 V. In the cathodic direction the complimentary peaks are poorly resolved, but there are strong suggestions of reduction processes at −0.7 and −0.45 V.

The peak potential of the anodic process near −0.6 V was plotted against the log of the sweep rate (B. E. Conway, H. Angerstein-Kozlowska, and F. C. Hu, J. Vac, Sci, & Tech. 14 (1977 ) 351 ). The reversible potential was found to be −0.59 V vs SCE. The next step in the analysis is to compare this value with thermodynamic data for oxidation of molybdenum species. According to the thermodynamic data for equation 3, the standard potential for the half reaction is −0.57 V vs SCE $$Mo+2H_2O \rightleftharpoons MoO_2+4e^-+2H^+ \quad (3)$$

Figure 5:
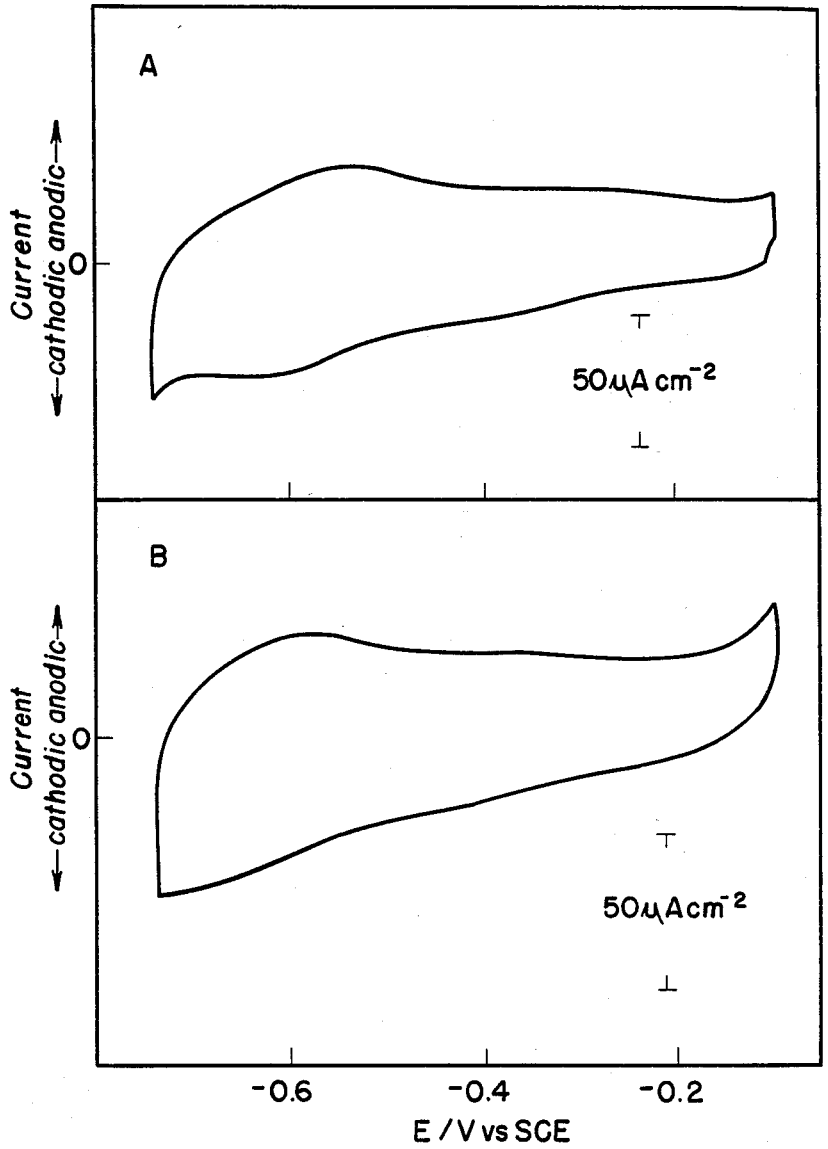
FIG. 5 illustrates cyclic voltammetry at 2.5 V per minute in nitrogen saturated, pH 4.2, 0.2 M $Na_2SO_4$ aqueous solution of (a) KOH/HF pretreated molybdenum electrode and (b) KOH/HF pretreated molybdenum electrode used for electrolysis of a carbon dioxide saturated, pH 4.2, 0.2 M $Na_2SO_4$ aqueous solution for 76 hours at −0.8 V vs. SCE.

(B. E. Conway, H. Angerstein-Kozlowska and F. C. Hu, J. Vac, Sci, & Tech. 14 (1977 ) 351 ) at pH =4.2. The agreement with our result of −0.59 V suggests that we are observing the oxidation and reduction of molybdenum metal and a molybdenum dioxide film. The results do not show if the oxide originates from the pretreatment with HCl or open circuit corrosion under nitrogen. An electrode scanned immediately after a KOH/HF pretreatment shows much smaller peaks (FIG. 5).

After a similar pretreatment the same experiment was repeated with nitrogen replaced by carbon dioxide. After one hour at open circuit the cyclic voltammetry shown in FIG. 3 was obtained. The curve with the largest current corresponds to a sweep rate of 6 V $min^{-1}$ Compared to the 6 V $min^{-1}$ curve in FIG. 2 (fifth from the top) it can be seen that the anodic and cathodic currents were increased after exposure to aqueous carbon dioxide at open circuit. The difference in peak current is 0.13 mA or 0.037 mA $cm^{-1}$. A somewhat larger increase of 0.12 mA was observed for the cathodic peak current at 6 V $min^{-1}$. In general, increases in current were observed for all sweep rates in both the anodic and cathodic directions. The reversible potential for the larger anodic peak was again found to correspond to reaction 3. Dissolved carbon dioxide or carbonic acid thus appear to cause the oxidation of the molybdenum electrode at open circuit. In view of the finding that CO is formed at open circuit, the potentiodynamic data confirm that $CO_2$ reduction and molybdenum oxidation occur simultaneously. The molybdenum oxide film thickness and the rate of corrosion by carbon dioxide during the first hour can be estimated as follows. Molybdenum has a face centered cubic structure with $N_o=5.1\times10^{14}$ atoms $cm^{-2}$ on the low index planes. The integral charge for the −0.6 V peak under the 3 V $min^{-1}$ sweep in FIG. 2 (see arrow) corresponds to ~0.5 monolayers. At this sweep rate and below determined the surface oxidation process is reversible. After one hour exposure to the carbon dioxide saturated electrolyte, the same kind of analysis for the 3 V $min^{-1}$ sweep in FIG. 3 gave ~1 monolayer of oxide. It follows that the rate of CO formation by carbon dioxide is about $9\times10^{-10}$ $hr^{-1}$ $cm^{-2}$. The corresponding rate of CO formation in current density units is 0.05 μA cm−1. It should be noted that this figure applies to a surface that already contains some oxide and should be comparable to the 0.04 μA $cm^{-1}$ (66 hour average in Table 3) determined by chemical analysis for CO. Reasonable agreement is noted.

Figure 4:
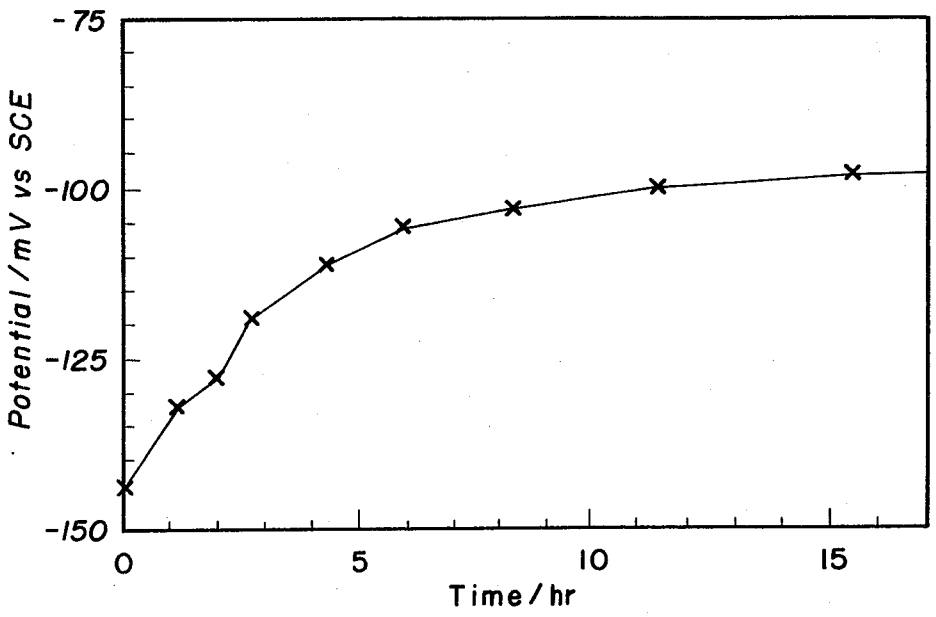
FIG. 4 illustrates free corrosion potential versus time for a KOH/HF pretreated molybdenum electrode in carbon dioxide saturated aqueous solution having a pH 4.2 and being 0.2 M in $Na_2SO_4$.

Corrosion of the molybdenum metal does not continue indefinitely. As the data in Table 3 (lines 2 and 3) indicate, after 46 hours no more carbon monoxide is formed. This indicates that, with regard to corrosion, passivation of the electrode surface occurs. In FIG. 4 we see the potential of the electrode used for the first experiment in Table 3 as a function of time for the first 16 hours. After 16 hours the potential was constant (±0.01 V) for the next 110 hours. Initially the open circuit potential rises from a potential of −0.145 V vs SCE in conjunction with the production of CO by corrosion of the molybdenum metal. The reason for the rise in potential is the passivation of the electrode that is occurring during the corrosion. If the corrosion couple in a corrosion reaction slows down, the open circuit potential must move to increase the rate of the corrosion couple relative to the other couple, since the rates of both couples must be equal in an open circuit reaction. The rise in the potential indicates that it is oxidation of the molybdenum metal that passivation is slowing and the potential moves more positive to increase the driving force for molybdenum oxidation. From the thermodynamics of the corrosion reaction vide supra it is apparent that the amount of CO produced is far from the equilibrium value indicating that the reaction does not stop simply because it came to equilibrium but that it was indeed passivation. Since black molybdenum dioxide can be seen forming on the surface of electrode during corrosion vide supra it is likely that it is the growth of an oxide film that causes the passivation.

Figure 3:
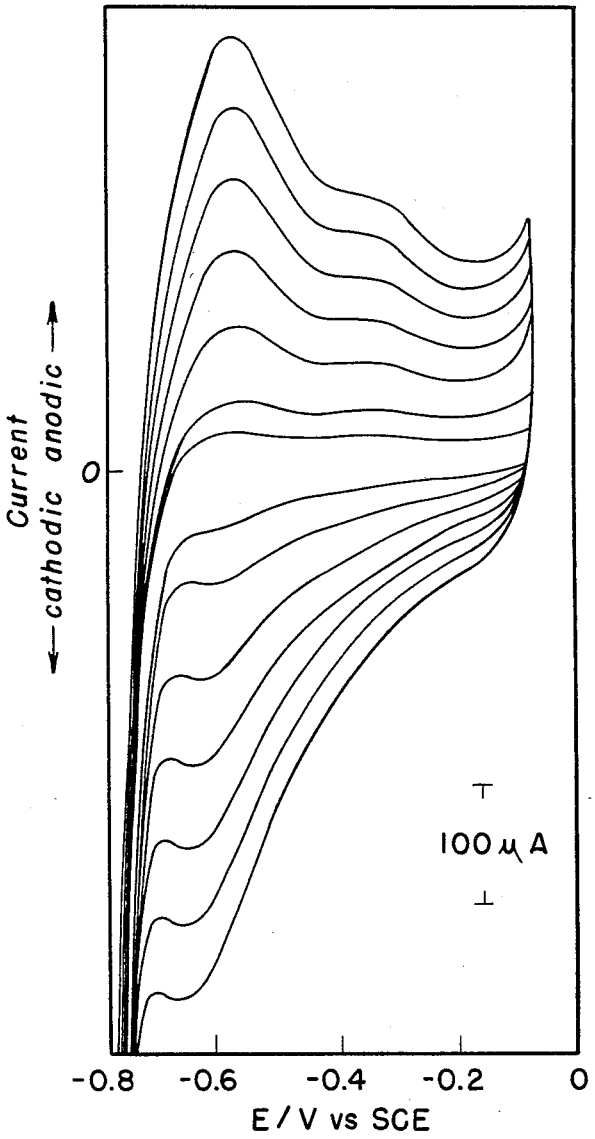
FIG. 3 illustrates cyclic voltammetry for a molybdenum electrode in carbon dioxide saturated 0.2 M $Na_2SO_4$, pH 4.2 aqueous solution, electrode being HCl pretreated and allowed to sit at open circuit for one hour before scanning, sweep rate being 0.5 to 6 V per minute and the electrode area being 3.4 $cm^2$.

The fact that the free corrosion current is <1 μA $cm^{-2}$ (Table 3) indicates that the production of methanol during electrolysis does not occur only by corrosion. Indeed, since the free corrosion potential is −0.15 to −0.1 V vs SCE the rate of corrosion at electrolysis potentials of −0.7 to −0.8 V vs SCE will be even smaller. This does not prove corrosion does not occur in parallel with electrolysis. However analysis of the solution used for experiment 2 A in Table 2 by atomic absorption indicates no molybdenum is present to a limit of 0.5 μM. To look for the formation of insoluble corrosion products the surface of the electrode was analyzed electrochemically. FIG. 5*a* shows the cyclic voltammetry of a molybdenum electrode just pretreated with KOH/HF while FIG. 5*b* illustrates the case of an electrode which had been treated in an identical manner but had also been used to electrolyze a carbon dioxide solution at −0.8 V vs SCE for 76 hours, passing 40 coulomb and making methanol with a faradaic efficiency of 30%. It can be seen that the size of the waves for molybdenum oxide on the surface are qualitatively the same and no surface bound corrosion products are formed. These results contrast with the large corrosion effects seen when electrodes are exposed to aqueous carbon dioxide at open circuit (FIGS. 2 and 3). The lack of corrosion products, soluble or insoluble, indicates no corrosion occurs during electrolysis to a lower limit of 0.05 μA $cm^{-2}$ free corrosion current.

Electrolysis With Cycled Electrodes

Platinum electrodes are often cycled to produce clean surfaces and good catalytic properties. If molybdenum electrodes are cycled in carbon dioxide 0.2 M $Na_2SO_4$, pH 4.2 solution between −1.2 and +0.2 V vs SCE before electrolysis, current efficiencies greater than 100% are found (Tables 4 and 5). Efficiencies greater than 100% are never observed on uncycled electrodes whether pretreated with HCl or KOH/HF. Like electrodes that are used with no cycling vide supra, cycled electrodes showed continued production of methanol during extended electrolysis (3 rd and 4 th entries in Table 5). However, in the case of cycled electrodes faradaic efficiencies do not decline significantly with time.

Figure 6:
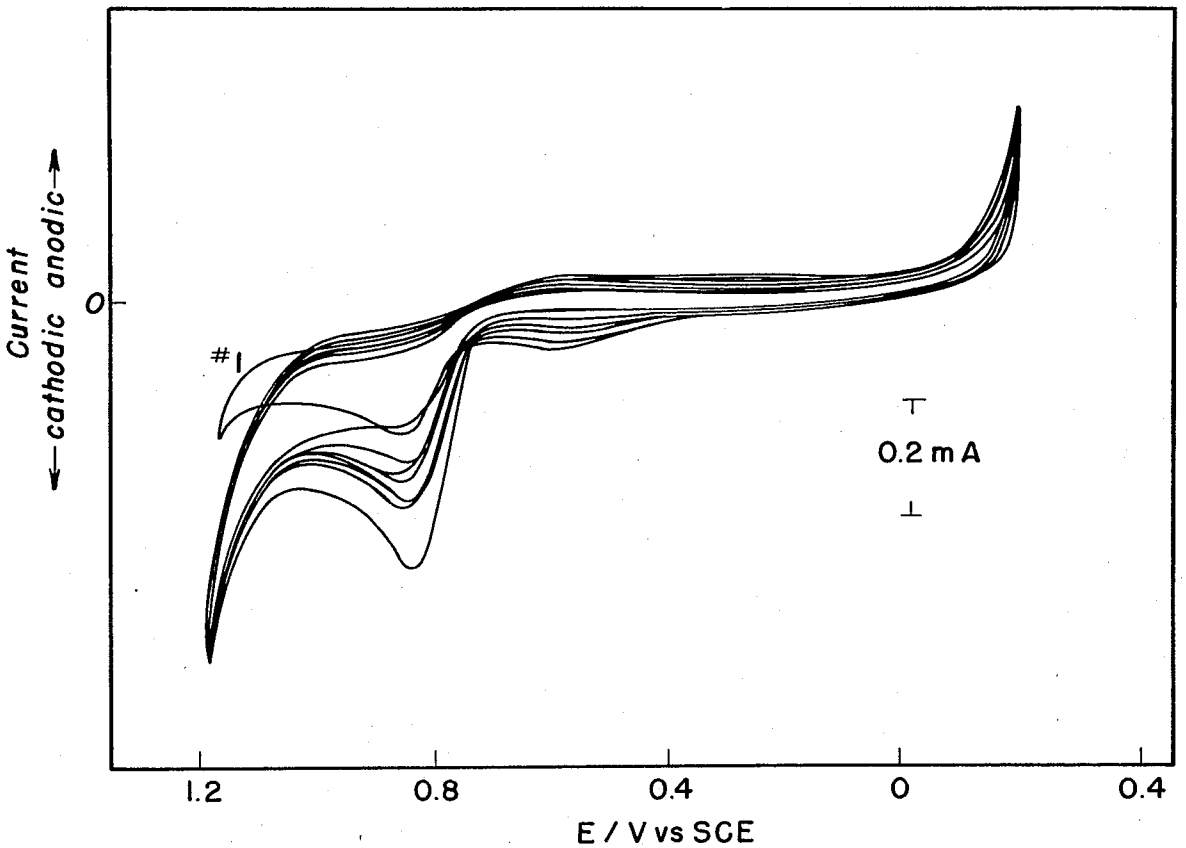
FIG. 6 illustrates cyclic voltammetry of a KOH/HF pretreated, 2.9 $cm^2$ molybdenum electrodes being cycled in a carbon dioxide saturated, pH 4.2, 0.2 M $Na_2SO_4$ aqueous solution for 7 minutes.
Figure 7:
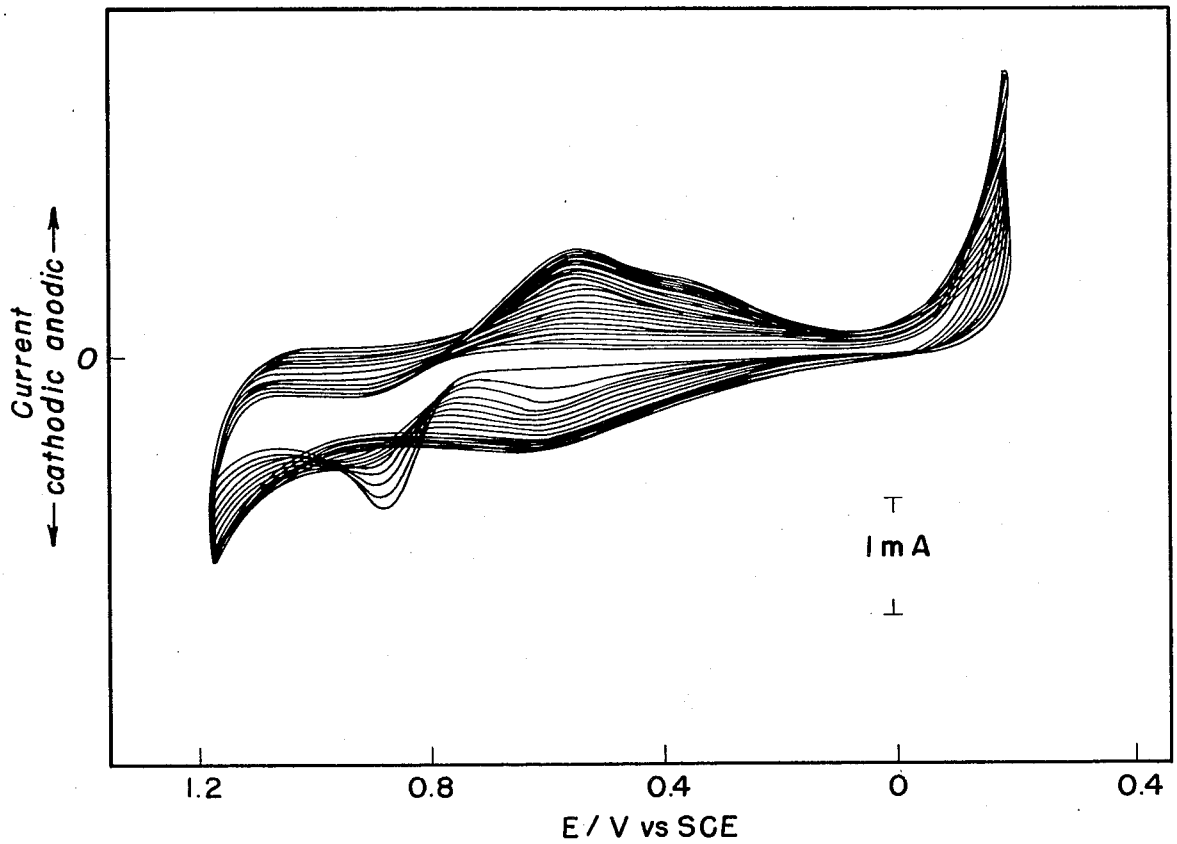
FIG. 7 illustrates cyclic voltammetry of a KOH/HF pretreated, 3.0 $cm^2$ molybdenum electrode being cycled in a carbon dioxide saturated, pH 4.2, 0.2 M $Na_2SO_4$ aqueous solution for 25 minutes.

FIGS. 6 and 7 show the cyclic voltammetry for KOH.HF pretreated molybdenum electrodes in carbon dioxide saturated 0.2 M $Na_2SO_4$, pH=4.2. The cycling time in FIG. 6 is 7 minutes corresponding to the first 8 cycles. The principle features include oxidation of the molybdenum to an oxide film (and possibly soluble species) commencing at +0.1 V vs SCE, reduction of surface oxides at −0.6 V vs SCE, and a hydrogen evolution wave beginning near −1.0 V vs SCE. The peak at −0.85 V is present when the electrode is cycled under nitrogen so is probably due to adsorbed hydrogen. As FIG. 6 illustrates, the peak at −0.85 V decreases in the early stages of cycling.

TABLE 4

Faradaic Efficiencies for CO, and $CH_3OH$ on cycled molybdenum electrodes.[a]

| Pretreatment | E/ SCE | j[b]/ μA $cm^{-2}$ | Q/ coul | Efficiency[c] CO | $CH_3OH$ |
|---|---|---|---|---|---|
| HCl | −0.7 | 49.5 | 8.6 | 4.4 | 118 |
| HCl[d] | −1.0 | 170 | 30 | N.D.[e] | 9.5 |
| HCl | −0.7 | 19 | 2.8 | 5.5 | 370 |
| HCl | −0.8 | 147 | 25 | N.D.[e] | 370 |
| HCl | −0.8 | 107 | 8.5 | 0.3 | 240 |
| KOH/HF | −0.8 | 91 | 10 | N.M.[f] | 246 |
| KOH/HF | −0.8 | 79 | 32.1 | 1.8 | N.M.[f] |

[a]All electrodes were cycled between −1.0 and +0.2 V vs SCE before electrolysis. Electrolyses in $CO_2$ saturated 0.2 M $Na_2SO_4$ aqueous solution.
[b]Average current density.
[c]% faradaic efficieny. In all cases no methane was detected by GC analysis.
[d]Same electrode as previous experiment but oxide had turned black.
[e]N.D. = not detected.
[f]N.M. = not measured.

TABLE 5

Effect of Cycling Time on the Faradaic Efficiencies for CO, and $CH_3OH$ of molybdenum electrodes.[a]

| Cycling time/min | E/ SCE | j[b]/ μA $cm^{-2}$ | Q/ coul | Efficiency[c] CO | $CH_3OH$ |
|---|---|---|---|---|---|
| 0[d] | −0.8 | 120 | 14 | N.D.[e] | 84 |
| 7 | −0.8 | 61 | 8.4 | <0.6 | 280 |
| 7[f] | −0.8 | 42 | 22 | 8.8 | 264 |
| 15 | −0.8 | 91 | 10 | N.M.[g] | 246 |

TABLE 5-continued

Effect of Cycling Time on the Faradaic Efficiencies for CO, and $CH_3OH$ of molybdenum electrodes.[a]

| Cycling time/min | E/ SCE | j[b]/ μA cm$^{-2}$ | Q/ coul | Efficiency[c] CO | $CH_3OH$ |
|---|---|---|---|---|---|
| 25 | −0.8 | 110 | 18 | 2.7 | 61 |

[a]All electrodes were cycled between −1.0 and +0.2 V vs SCE before electrolysis. Electrolyses in $CO_2$ saturated 0.2 M $Na_2SO_4$ aqueous solution.
[b]Average current density.
[c]% faradaic efficiency.
[d]Same data as presented in experiment 2A of Table 2.
[e]N.D. = not detected.
[f]This entry is a continuation of the previous experiment. Values are cumulative.
[g]N.M. = not measured.

The effects of longer cycling times are seen in FIG. 7 which shows a different electrode cycled for 25 minutes. The cathodic peak at −0.85 V eventually disappears after 10 -15 cycles. The peak due to cathodic formation of metal from metal ocide at 0.6 V, and the complimentary anodic peak at −0.55 V, grow with time though the rate of growth slows with longer cycling times. Also, the current due to oxidation of the molybdenum electrode at +0.1 V declines.

The effect of cycling time on the faradaic efficiency for methanol production can be seen from the data in Table 5. Apparently there is an optimum cycling time and if an electrode is cycled too long it becomes passivated. Comparison of the data in Table 5 and in FIGS. 6 and 7 indicates that the >100% efficiencies are associated with the decline in the peak at −0.85 V. The passivation caused by extended cycling is associated with the growth in the molybdenum dioxide peak at −0.6 V (FIG. 7) indicating that it is the coverage of the surface with a passivating oxide layer that causes passivation.

Since more methanol is produced than is possible on the basis of the charge passed during electrolysis there must be a source of electrons in addition to those supplied by the external circuit. The only two reasonable sources are from the "storage" of reducing equivalents on the surface through the formation of a reducing surface film during the cycling pretreatment, or from corrosion of the metal. A reducing surface could occur by the formation of molybdenum dioxide on the surface of the electrode during the anodic portion of the cycle which is then reduced during cycling to a species capable of reducing carbon dioxide to methanol.

A likely candidate is the formation of a molybdenum bronze. Molybdenum bronzes are formed from the partial reduction, either chemical or electrochemical, of molybdenum trioxide which can be formed, along with molybdenum dioxide, during the electrochemical oxidation of molybdenum metal. Such materials are metallic or semimetallic in character and contain large amounts of hydrogen (R. Schollhorn and R. Kuhlmann, Mat. Res. Bull. 11 (1976) 83) making them plausible candidates for the reduction of carbon dioxide. If a sample of molybdenum bronze powder (produced from dithionite reduction of molybdenum trioxide powder) is added to a carbon dioxide saturated 0.2 M $Na_2SO_4$, pH =4.2 aqueous solution one can see, Table 6, that methanol and traces of carbon monoxide are indeed formed. To show that reduction was not occurring by residual dithionite absorbed to the powder a solution of dithionite was saturated with carbon dioxide or methanol was formed (Table 6).

The reduction of carbon dioxide by molybdenum dioxide (eq 4) to form carbon monoxide and $$MoO_2+CO_2+H_2O \quad H_2MoO_4+CO \tag{4}$$

molybdic acid ($H_2moO_4$) cannot be ruled out since it is downhill (Atlas of Electrochemical Equilibria in Aqueous Solutions, M. Pourbaix, National Association of Corrosion Engineers, Houston, Texas) by 192 kJ mol$^{-1}$. If molybdenum dioxide powder is suspended in a carbon dioxide saturated 0.2 M $Na_2SO_4$, pH 4.2 aqueous solution small amounts of carbon monoxide are formed and no methanol is detected (Table 6). Even though molybronzes can reduce carbon dioxide to methanol it will be shown below that there would be insufficient bronze formed on the electrode surface to account for the extra methanol.

Molybdenum dioxide can only donate two electrons for carbon dioxide reduction while the molybdenum bronze can supply about 1 electron per molybdenum center. Since oxidation of molybdenum metal to melybdenum dioxide is a four electron process the amount of charge available for reduction of carbon dioxide by a surface film can be greater than the anodic charge passed creating molybdenum dioxide. The fifth entry in Table 5 shows the data for an electrode that was cycled for 15 minutes and showed a faradaic efficiency of 246% when used for electrolysis. The anodic charge passed during cycling this electrode was only ~0.5 coul, far less than the 15 coulombs needed to account for the methanol produced in excess of 100% faradaic efficiency. Values in the 0.1 to 0.2 coul range for the anodic charge passed during cycling are typical for such experiments. Since the coulombs measured during cycling cannot account for the extra methanol formed the coulombs must come from the molybdenum metal. Thus, the effect of cycling is to activate the molybdenum metal for corrosion. Consistent with these results is the fact that, although uncycled molybdenum electrodes will not make methanol at open circuit, open circuit corrosion of cycled molybdenum wire will make methanol (Table 3). The free corrosion current density is also higher for cycled electrodes and there is no indication of passivation against corrosion with time.

TABLE 6

Chemical Reduction of carbon dioxide.[a]

| Reductant | Amount | Time/ hr | $CH_3OH$/ μmol | $CH_3OH$/ μmol g$^{-1}$ hr$^{-1}$ | CO/ μmol | CO/ μmol g$^{-1}$ hr$^{-1}$ |
|---|---|---|---|---|---|---|
| $MoO_2$[b] | 2 g | 24 | N.D.[c] | 0 | 0.025 | 0.0005 |
| Molybronze[b] | 1 g | 40 | 18 | 0.4 | 0.044 | 0.001 |
| $Na_2S_2O_4$ | 0.05 M | 61 | N.D.[c] | 0 | N.D.[c] | 0 |

[a]In carbon dioxide saturated aqueous solution. In all cases no methane was detected.
[b]In 0.2 M $Na_2SO_4$ pH = 4.2.
[c]N.D. = not detected.

CONCLUSIONS

It has been shown that carbon dioxide can be converted to methanol with good selectivity and yield under appropriate conditions. The faradaic efficiency depends on several factors including chemical surface pre-treatment and voltage cycling pretreatment. Methanol formation continues during extended electrolysis though a drop in faradaic efficiency is observed. From spectroscopic analysis of the electrolyte for soluble molybdenum species and electrochemical analysis of the surface for insoluble molybdenum compounds it is concluded that the formation of corrosion products is inhibited under electrolysis conditions.

By contrast, open circuit corrosion of molybdenum can lead to carbon monoxide or methanol depending on whether the electrode has been voltage cycled. The equivalent free corrosion current is $\leqq 1\ \mu A\ cm^{-2}$, well below typical electrolysis current densities.

Voltage cycled electrodes are much more susceptible to corrosion under electrolysis conditions. In this case carbon dioxide reacts rapidly with molybdenum metal to form methanol selectively. It was also shown that molybdenum bronzes are a chemical reducing agent for methanol synthesis from aqueous carbon dioxide.

More generally, and as supported by the extensive data in the examples set forth above, carbon dioxide can be efficiently converted to produce methanol. Generally, the pH of the solution should fall within the range from about 0 to about 7. If the pH is in the range from about 5 to about 7, it is necessary to have an added electrolyte. If the pH is below about 5, the acid provides sufficient electrolyte. Generally, the cathode is controlled to have a voltage from about −0.5 V to about −1.1 V relative to SCE. Furthermore, if the cathode is cycled between two voltages which fall in the range from about −1.2 V and plus 0.2 V, relative to SCE, over 100% faradaic efficiency for production of methanol from carbon dioxide results, but, this is apparently due to corrosion of the cathode.

INDUSTRIAL APPLICABILITY

The method of the present invention is useful for converting carbon dioxide to methanol whereby energy such as solar energy can be readily converted to storable form, namely, by providing a fuel which can be burned to recapture the energy.

While the invention has been described with respect to certain specific embodiments thereof it will be understood that many variations are possible within the scope and spirit of the invention as defined by the appended claims.

We claim:

1. A method of producing methanol from carbon dioxide, comprising:

electrolyzing a solution of carbon dioxide in an aqueous solvent having an electrolyte therein and utilizing a cathode which comprises molybdenum to produce methanol.

2. A method as set forth in claim 1, wherein the pH of the solution falls within the range from about 0 to about 7.

3. A method as set forth in claim 1, wherein the cathode is controlled to have a voltage from about −0.5 V to about −1.1 V relative to SCE.

* * * * *